US008646526B2

(12) United States Patent
Suarez-Rivera et al.

(10) Patent No.: US 8,646,526 B2
(45) **Date of Patent: *Feb. 11, 2014**

(54) METHOD AND SYSTEM FOR INCREASING PRODUCTION OF A RESERVOIR USING LATERAL WELLS

(75) Inventors: Roberto Suarez-Rivera, Salt Lake City, UT (US); Sidney Green, Salt Lake City, UT (US); Chaitanya Deenadayalu, Salt Lake City, UT (US)

(73) Assignee: TerraTek, Inc., Salt Lake City, UT (US)

( * ) Notice: Subject to any disclaimer, the term of this patent is extended or adjusted under 35 U.S.C. 154(b) by 694 days.

This patent is subject to a terminal disclaimer.

(21) Appl. No.: 12/203,884

(22) Filed: Sep. 3, 2008

(65) Prior Publication Data

US 2009/0065198 A1 Mar. 12, 2009

Related U.S. Application Data

(60) Provisional application No. 60/969,935, filed on Sep. 4, 2007.

(51) Int. Cl.
*E21B 49/00* (2006.01)

(52) U.S. Cl.
USPC ..... 166/250.1; 166/50

(58) Field of Classification Search
USPC ..... 166/250.01, 250.1, 308.1, 50; 175/61, 175/62
See application file for complete search history.

(56) References Cited

U.S. PATENT DOCUMENTS

| | | | | | |
|---|---|---|---|---|---|
| 3,537,529 | A | * | 11/1970 | Timmerman | 166/271 |
| 3,682,246 | A | * | 8/1972 | Closmann | 166/271 |
| 3,771,600 | A | * | 11/1973 | Hill | 166/299 |
| 4,633,948 | A | * | 1/1987 | Closmann | 166/271 |
| 5,074,360 | A | * | 12/1991 | Guinn | 166/281 |
| 5,314,019 | A | * | 5/1994 | Honarpour | 166/270 |
| 5,386,875 | A | * | 2/1995 | Venditto et al. | 166/308.1 |
| 5,868,210 | A | * | 2/1999 | Johnson et al. | 175/40 |
| 5,964,295 | A | | 10/1999 | Brown et al. | |
| 6,591,903 | B2 | * | 7/2003 | Ingle et al. | 166/50 |
| 7,104,320 | B2 | * | 9/2006 | Buchanan et al. | 166/245 |
| 2005/0087367 | A1 | * | 4/2005 | Hutchinson | 175/45 |
| 2006/0175061 | A1 | * | 8/2006 | Crichlow | 166/302 |
| 2007/0158072 | A1 | * | 7/2007 | Coleman et al. | 166/298 |
| 2007/0158073 | A1 | * | 7/2007 | Green | 166/313 |
| 2008/0162098 | A1 | | 7/2008 | Suarez-Rivera et al. | |

OTHER PUBLICATIONS

Craig Cipolla, Dr. Norman Warpinski, Dr. Michael Mayerhofer, Dr. Shawn Maxwell, "Hydraulic Fracture Diagnostics: Understanding Fracture Geometry and Well Performance", Pinnacle Technologies, Inc., (2 pages).

C.L. Cipolla and C.A. Wright, "Diagnostic Techniques to Understand Hydraulic Fracturing: What? Why? and How?", SPE Production & Facilities, Pinnacle Technologies, Feb. 2002 (13 pages).

PCT Notification of Transmittal of the International Search Report and the Written Opinion of the International Searching Authority, or the Declaration, May 24, 2011.

* cited by examiner

*Primary Examiner* — David Bagnell
*Assistant Examiner* — Kipp Wallace
(74) *Attorney, Agent, or Firm* — Robert P. Lord; Wayne I. Kanak

(57) ABSTRACT

A method for stimulating production in a wellbore associated with a reservoir. The method includes determining a textural complexity of a formation in which the reservoir is located, determining an induced fracture complexity of the formation using the textural complexity, fracturing the formation to create a plurality of fractures, determining an operation to perform within the formation to maintain conductivity of the formation based on the induced fracture complexity and the textural complexity, and performing the operation, wherein the operation comprises drilling a lateral well originating from the wellbore to maintain conductivity of the formation.

20 Claims, 8 Drawing Sheets

METHOD AND SYSTEM FOR INCREASING PRODUCTION OF A RESERVOIR USING LATERAL WELLS

CROSS REFERENCE TO RELATED APPLICATIONS

This application claims priority pursuant to 35 U.S.C. §119(e) to U.S. Provisional Patent Application No. 60/969,935 entitled "Methodology for Increasing Production of a Reservoir, Using Lateral Wells" filed Sep. 4, 2007 in the names of Roberto Suarez-Rivera, Sidney Green, Chaitanya Deenadayalu, David Handwerger and Yi-Kun Yang, the entire contents of which are incorporated herein by reference.

BACKGROUND

1. Field of the Invention

In general, the invention relates to techniques to increase and/or optimize production of a reservoir.

2. Background Art

The following terms are defined below for clarification and are used to describe the drawings and embodiments of the invention:

The "formation" corresponds to a subterranean body of rock that is sufficiently distinctive and continuous. The word formation is often used interchangeably with the word reservoir.

A "lateral well" is a wellbore that is drilled at some angle to, and originating from, an original wellbore. Such angle may be at a right angle to the wellbore, or at some other angle.

A "reservoir" is a formation or a portion of a formation that includes sufficient permeability and porosity to hold and transmit fluids, such as hydrocarbons or water.

The "porosity" of the reservoir is the pore space between the rock grains of the formation that may contain fluid.

The "permeability" of the reservoir is a measurement of how readily fluid flows through the reservoir.

A "fracture" is a crack or surface of breakage within rock not related to foliation or cleavage in metamorphic rock along which there has been no movement. A fracture along which there has been displacement is a fault. When walls of a fracture have moved only normal to each other, the fracture is called a joint. Fractures may enhance permeability of rocks greatly by connecting pores together, and for that reason, fractures are induced mechanically in some reservoirs in order to boost hydrocarbon flow.

The word "conductivity" is often used to describe the permeability of a fracture.

There are typically three main phases that are undertaken to obtain hydrocarbons from a given field of development or on a per well basis. The phases are exploration, appraisal and production. During exploration one or more subterranean volumes (i.e., formations or reservoirs) are identified that may include fluids in an economic quantity.

Following successful exploration, the appraisal phase is conducted. During the appraisal phase, operations, such as drilling wells, are performed to determine the size of the oil or gas field and how to develop the oil or gas field. After the appraisal phase is complete, the production phase is initiated. During the production phase fluids are produced from the oil or gas field.

More specifically, the production phase involves producing fluids from a reservoir. The wellbore is created by a drilling operation. Once the drilling operation is complete and the wellbore is formed, completion equipment is installed in the wellbore and the fluids are allowed to flow from the reservoir to surface production facilities.

Production may be enhanced using a variety of techniques, including well stimulation, which may include acidizing the well or hydraulically fracturing the well to enhance formation permeability. In some reservoirs, especially high modulus reservoirs such as tight gas shales, tight sands or naturally unfractured carbonates, fracture surface area, either natural or induced, may be directly correlated to well production, that is, the rate at which fluids may be produced from the reservoir. As such, it may be beneficial to locate such high modulus reservoirs that include a large fracture surface area. In cases where the high modulus reservoir does not include fractures (or a sufficient fracture surface area for economic production), the high modulus reservoir may be fractured to increase the fracture surface area. In high modulus rocks small deformations result in high stresses with a large radius of influence. Accordingly, shear stresses and shear displacements in these reservoirs may be developed by promoting asymmetries, for example by introducing zones of compliance or high stiffness in the region to be fractured.

While the fracturing increases the fracture surface area, the fractures must remain open for the fluid to flow from the reservoir to the surface. If the fractures resulting from the fracturing are simple, then proppant (such as, but not limited to, sand, resin-coated sand or high-strength ceramic or other materials) may be used keep the fracture from closing and to maintain improved conductivity.

Highly complex fractures generally give improved production rates. While the production of a fracture with high complexity and, thus, high surface area may theoretically be matched by a simple fracture of equivalent surface area, creating multiple simpler fractures (for example, by increasing the number of stages) may provide similar results to a complex fracture. However, this approach may be expensive and logistically complex. An additional benefit of complex fracturing is the resultant higher fracture density per unit of reservoir volume, which increases the overall reservoir recovery. In other words, not only is there a faster rate of production of the fluids that are generally recoverable, but more of the oil or gas in the reservoir may be recovered instead of being left behind, as would otherwise occur. However, if the fractures resulting from the fracturing are complex (e.g., branched), then using proppant may not be sufficient to prop the fractures. The proppant may not, for example, be adequately delivered to all of the branches of the fracture, or the density of the proppant delivered might be insufficient to maintain conductivity. Those portions of the fracture might then close, thereby reducing fracture conductivity.

While reservoirs have been stimulated for many decades, a need exists for a method, apparatus and system to determine the particular conditions affecting the treatment of the individual reservoir (e.g., near-wellbore effects, reservoir heterogeneity and textural complexity, in-situ stress setting, rock-fluid interactions). A need exists for a method, apparatus and system to detect the conditions required for generating induced fracture complexity, high fracture density, and large surface area during fracturing, and use this data to anticipate fracture geometry and adapt all other aspects of the design to optimize production and hydrocarbon recovery. A need exists for a method, apparatus and system to identify unique conditions of reservoir properties, in-situ stress, and completion settings to determine a design of fracture treatments that specifically adapt to these conditions. For example, the positive and negative consequences of induced fracture complexity, e.g., the increase in surface area for flow and the increase of the drainage area, versus the increase in surface area for detrimental rock-fluid interactions, the increase in tortuosity of the flow paths and its detrimental effect on proppant transport, proppant placement, and in the associated difficulties in preserving fracture conductivity are all factors which, when accounted for, allow adapting the fracture design accordingly (e.g., changing fluids, additives and pumping conditions). A need exists for a method, apparatus and system to promote the self-propping of complex fractures and complex fractured regions. This is important because the more complex and extensive the produced fracture, the more tortuous the flow path and, accordingly the more difficult it is to deliver proppant for preserving fracture conductivity. A need exists for a method, apparatus and system to identify operational techniques for enhancing the self-propping of fractures and for improving the distribution of proppant along the fracture, thus retaining fracture conductivity and enhancing well production. A need exists for a method, apparatus and system for monitoring these effects (e.g., via real-time micro-seismic emission, surface deformations, or equivalent), to adapt in real-time, to the conditions of the treatment, and to validate the fracture geometry and complexity anticipated during the evaluation phase. A need exists for a method, apparatus and system to allow data collection for post analysis evaluation, to continuously improve the methodology by including complexities that may be local to a particular field or segment of the field, or previously not anticipated.

SUMMARY

In general, in one aspect, the invention relates to a method for stimulating production in a wellbore associated with a reservoir. The method includes determining a textural complexity of a formation in which the reservoir is located, determining an induced fracture complexity of the formation using the textural complexity, fracturing the formation to create a plurality of fractures, determining an operation to perform within the formation to maintain conductivity of the formation based on the induced fracture complexity and the textural complexity, and performing the operation, wherein the operation comprises drilling a lateral well originating from the wellbore to maintain conductivity of the formation.

In general, in one aspect, the invention relates to a method for stimulating production in a reservoir. The method includes determining a textual complexity of a formation in which the reservoir is located, determining an induced fracture complexity of the formation using the textual complexity, determining a location to drill a first wellbore using the fracture complexity, drilling, at the location, the first wellbore comprising a lateral well in the formation, drilling a second wellbore in the formation, pressurizing the second wellbore using fracturing fluid to create a plurality of fractures, wherein at least one of the plurality of fractures penetrates the first wellbore and wherein the at least one the plurality of fractures induces a fracture in the first wellbore, and producing hydrocarbons from at least one selected from a group consisting of the first wellbore, the second wellbore, and a third wellbore in the formation.

In general, in one aspect, the invention relates to a method for stimulating production in a reservoir. The method includes determining a textural complexity of a formation in which the reservoir is located, determining an induced fracture complexity of the formation using the textural complexity, determining a location to drill a first wellbore using the induced fracture complexity, drilling, at the location, the first wellbore comprising a lateral well, drilling a second wellbore in the formation, filling the second wellbore with a material, wherein the material sets in the second wellbore to create shear stress in the formation and wherein the shear stress induces a plurality of fractures in the formation, and producing hydrocarbons from at least one selected from a group consisting of the first wellbore and a third wellbore in the formation.

In general, in one aspect, the invention relates to a method for stimulating production in a reservoir. The method includes determining a textural complexity of a formation in which the reservoir is located, determining an induced fracture complexity of the formation using the textural complexity, determining a location to drill a first wellbore using the induced fracture complexity, drilling, at the location, the first wellbore, inducing a first plurality of fractures in a volume surrounding the first wellbore, filling the first plurality of fractures with a material, wherein the material sets in the first plurality of fractures to induce shear stress in the formation, inducing fracturing in the volume surrounding the first wellbore after the material sets to generate a second plurality of fractures, and producing hydrocarbons from the first wellbore and a second wellbore in the formation.

In general, in one aspect, the invention relates to a method for drilling a wellbore. The method includes identifying a formation and a reservoir in the formation, determining a textural complexity of the formation, determining an induced fracture complexity of the formation using the textural definition, identifying a location of the wellbore based on the induced fracture complexity and the textural complexity, fracturing the formation to create a plurality of fractures, determining an operation to perform within the formation to maintain conductivity of the formation based on the induced fracture complexity and the textural complexity, drilling the wellbore at the location, and performing the operation within the formation, wherein the operation comprises drilling a lateral well originating from the wellbore to maintain conductivity of the formation.

In general, in one aspect, the invention relates to a computer readable medium embodying instructions executable by a computer to perform method steps for an oilfield operation, the oilfield having at least one wellsite, the at least one wellsite having a wellbore penetrating a formation for extracting fluid from a reservoir therein, the instructions including functionality to determine a textural complexity of a formation in which the reservoir is located, determine an induced fracture complexity of the formation using the textural complexity, fracture the formation to create a plurality of fractures, determine the operation to perform within the formation to maintain conductivity of the formation based on the induced fracture complexity and the textural complexity, and perform the operation within the formation, wherein the operation includes drilling a first lateral well originating from the wellbore to maintain conductivity of the formation.

Other aspects of the invention will be apparent from the following description and the appended claims.

DETAILED DESCRIPTION

Figure 1:
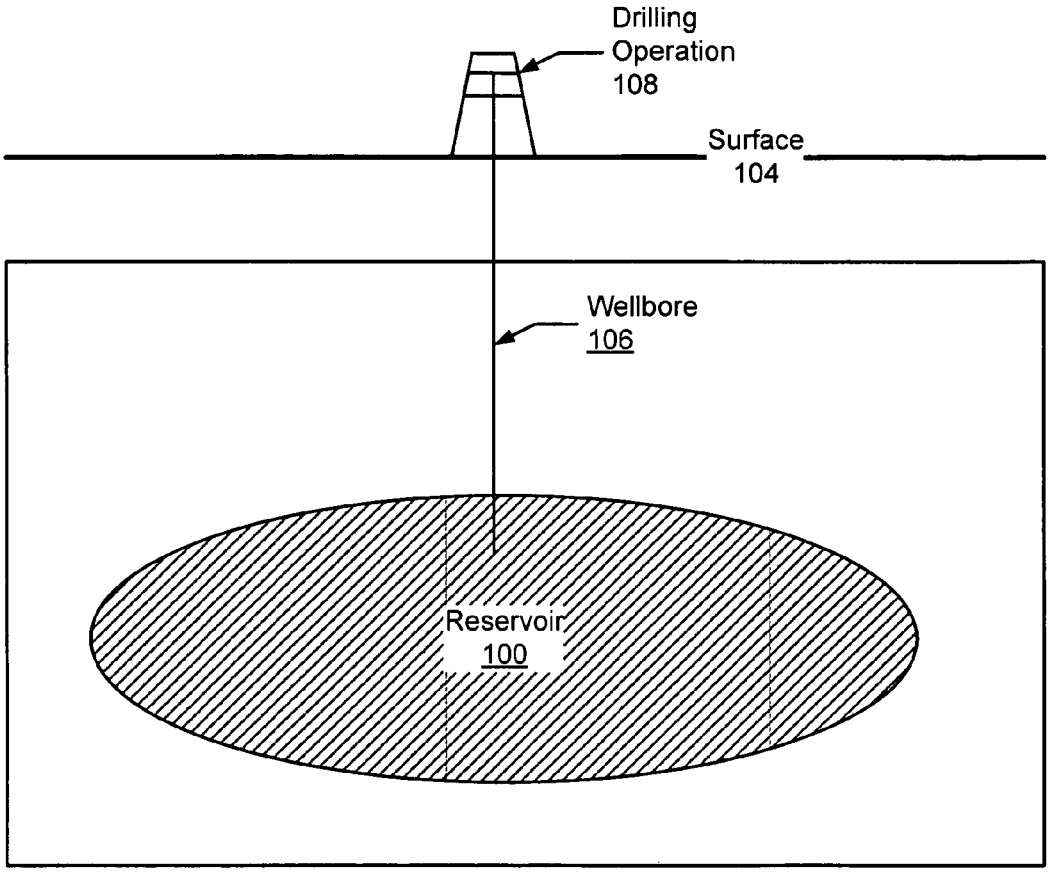
FIG. 1 depicts production of a reservoir in accordance with one embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention relate to a method for stimulating production by maintaining the conductivity of the fractures through the introduction of shear stress into the reservoir. Further, embodiments of the invention relate to method for drilling a well, where the method takes into account the induced fracture complexity of the reservoir in which the well is to be drilled. Embodiments of the invention may be applied to different types of formations. In particular, the invention may be applied, but is not limited to, high modulus formations, such as tight gas shales, tight sands, and unfractured carbonates.

As depicted in FIG. 1, fluids are produced from a reservoir (100). The reservoir (100) is accessed by drilling a wellbore (104) into a formation where the wellbore intersects with the reservoir. The wellbore (106) is created by a drilling operation (108). Fluids may also be injected into reservoirs to enhance recovery or for purposes of storage.

Figure 2A:
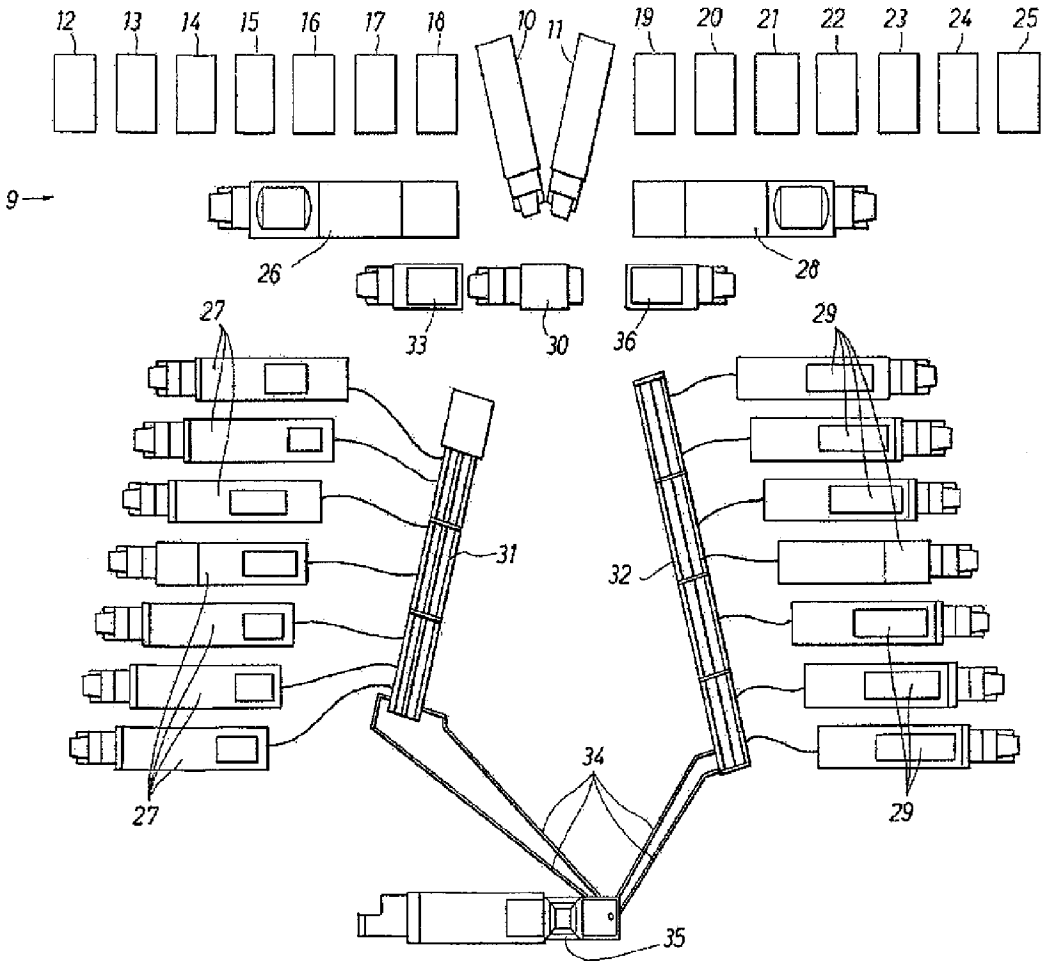
FIG. 2A depicts an example of a typical hydraulic fracturing operation.

FIG. 2A shows a fracture operation in accordance with one embodiment of the invention. A fracturing configuration (9) for a land-based fracture typically includes the equipment shown, which includes: (i) Sand trailers (10-11); (ii) water tanks (12-25); (iii) mixers (26, 28); (iv) pump trucks (27, 29); (v) a sand hopper (30); (vi) manifolds (31-32); (vii) blenders (33, 36); (viii) treating lines (34); and (ix) a rig (35). The sand trailers (10-11) contain proppant, e.g., sand, in dry form. The sand trailers (10-11) may also be filled with polysaccharide in a fracturing operation. The water tanks (12-25) store water for hydrating the proppant. Water is pumped from the water tanks (12-25) into the mixers (26) and (28). Pump trucks (27) and (29), shown on either side of FIG. 2A, contain on their trailers the pumping equipment needed to pump the final mixed and blended slurry downhole. This equipment may be modified to work in marine operations.

Continuing with the discussion of FIG. 2A, the sand hopper (30) receives proppant in its dry form from the sand trailers (10-11) and distributes the proppant into the mixers (26) and (28), as needed, to combine with the water pumped from the water tanks (12-25). In scenarios in which the sand trailers include polysaccharide, the polysaccharide may be hydrated in the mixers (26, 28) using water pumped from the water tanks (12-25). The blenders (33) and (36) further mix materials in the process. In particular, the blenders (33) and (36) are typically configured to receive the hydrated polysaccharide proppant from the mixers (26) and (28) and blending the hydrated polysaccharide with proppant. Once the blenders (33) and (36) finish mixing, the resulting mixed fluid material is transferred to manifolds (31) and (32), which distribute the mixed fluid material to the pump trucks (27) and (29). The pump trucks (27) and (29) subsequently pump the mixed fluid material under high pressure through treating lines (34) to the rig (35), where the mixed fluid material is pumped downhole. FIG. 2A is also described in U.S. Pat. No. 5,964,295, the entirety of which is incorporated by reference.

In one embodiment of the invention, maintaining the conductivity in a reservoir may include applying a stimulation treatment to the reservoir. In one embodiment of the invention, the stimulation treatment may be applied to a high modulus formation such as tight gas shale formation, tight sand formation or naturally unfractured carbonate formation prior to drilling additional wellbores into the reservoir. Alternatively, the stimulation treatment may be applied after the wellbore, as well as one or more secondary wellbores, are drilled into the high modulus reservoir.

The stimulation treatment may produce simple non-branched fractures, complex branched fractures, or a combination thereof. The simple non-branched fractures may be propped using proppant. While proppant in conventional hydraulic fracture operations may not suffice to adequately prop complex branched fractures, complex branch fractures may, in accordance with a preferred embodiment of the invention, be self-propped by the introduction of shear stress in the formation.

Figure 2B:
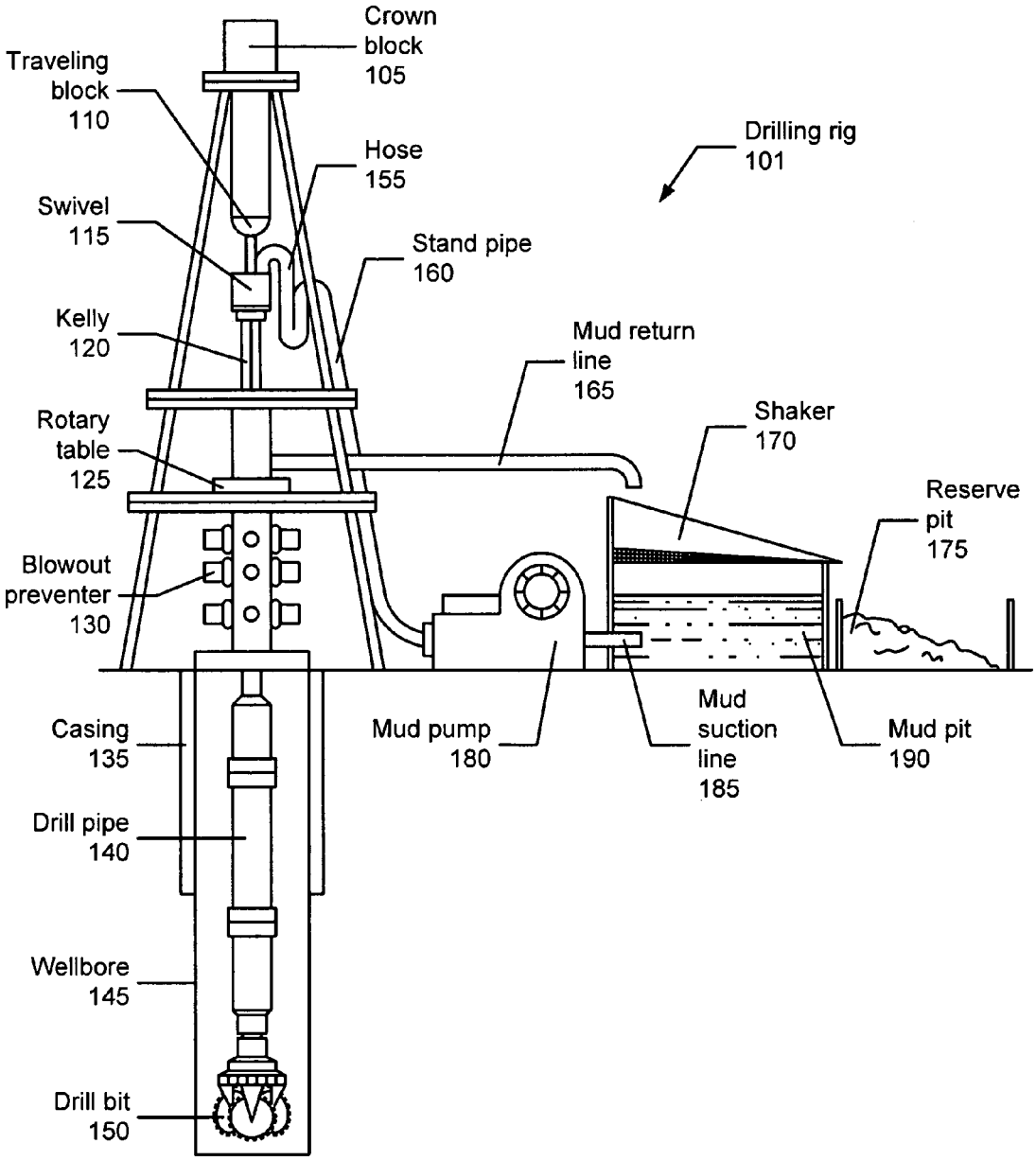
FIG. 2B depicts a drilling operation in accordance with one embodiment of the invention.

FIG. 2B depicts a diagram of a drilling operation, in which a drilling rig (101) is used to turn a drill bit (150) coupled at the distal end of a drill pipe (140) in a wellbore (145). The drilling operation may be used to provide access to reservoirs containing fluids, such as oil, natural gas, water, or any other type of material obtainable through drilling. Although the drilling operation shown in FIG. 2B is for drilling directly into an earth formation from the surface of land, those skilled in the art will appreciate that other types of drilling operations also exist, such as lake drilling or deep sea drilling.

As depicted in FIG. 2B, rotational power generated by a rotary table (125) is transmitted from the drilling rig (101) to the drill bit (150) via the drill pipe (140). Further, drilling fluid (also referred to as "mud") is transmitted through the drill pipe's (140) hollow core to the drill bit (150) and up the annulus (152) of the drill pipe (140), carrying away cuttings (portions of the earth cut by the drill bit (150)). Specifically, a mud pump (180) is used to transmit the mud through a stand pipe (160), hose (155), and kelly (120) into the drill pipe (140). To reduce the possibility of a blowout, a blowout preventer (130) may be used to control fluid pressure within the wellbore (145). Further, the wellbore (145) may be reinforced using one or more casings (135), to prevent collapse due to a blowout or other forces operating on the borehole (145). The drilling rig (101) may also include a crown block (105), traveling block (110), swivel (115), and other components not shown.

Mud returning to the surface from the borehole (145) is directed to mud treatment equipment via a mud return line (165). For example, the mud may be directed to a shaker (170) configured to remove drilled solids from the mud. The removed solids are transferred to a reserve pit (175), while the mud is deposited in a mud pit (190). The mud pump (180) pumps the filtered mud from the mud pit (190) via a mud suction line (185), and re-injects the filtered mud into the drilling rig (101). Those skilled in the art will appreciate that other mud treatment devices may also be used, such as a degasser, desander, desilter, centrifuge, and mixing hopper. Further, the drilling operation may include other types of drilling components used for tasks such as fluid engineering, drilling simulation, pressure control, wellbore cleanup, and waste management.

The drilling operation may also be used to drill one or more secondary wellbores, such as lateral wellbores and offset wellbores. One common operation used to drill a secondary, lateral wellbore (away from an original wellbore) is sidetracking. A sidetracking operation may be done intentionally or may occur accidentally. Intentional sidetracks might bypass an unusable section of the original wellbore or explore a geologic feature nearby. In this bypass case, the secondary wellbore is usually drilled substantially parallel to the original well, which may be inaccessible. The drilling of an offset wellbore (i.e., a nearby wellbore that provides information for well planning related to the proposed or underproducing well) may be used for the planning of development wells or the optimizing of well production by using data about the subsurface geology and pressure regimes.

The drilling operations may also be accompanied by fracturing operations, which may occur either before or after the well is completed. During completion operations, equipment is installed in the well to isolate different formations and to direct fluids, such as oil, gas or condensate, to the surface. Completion equipment may include equipment to prevent sand from entering the wellbore or to help lift the fluids to the surface if the reservoir's inherent or augmented pressure is insufficient.

Fracturing is a stimulation treatment used to increase production in reservoirs. Specially engineered fluids are pumped at high pressure and rate into the reservoir (or portion thereof) to be treated, causing a fracture to open. The wings of the fracture extend away from the wellbore in opposing directions according to the natural stresses within the formation. A proppant, such as but not limited to grains of sand of a particular size, may be mixed with the treatment fluid to keep the fracture open when the treatment is complete. Hydraulic fracturing creates high-conductivity communication with a large area of formation. One may not want to extend the fractures to establish communication with water-bearing formations, and if part of the target reservoir contains water, then one may also not want to extend the fractures into the water-bearing part of the reservoir either.

Figure 3:
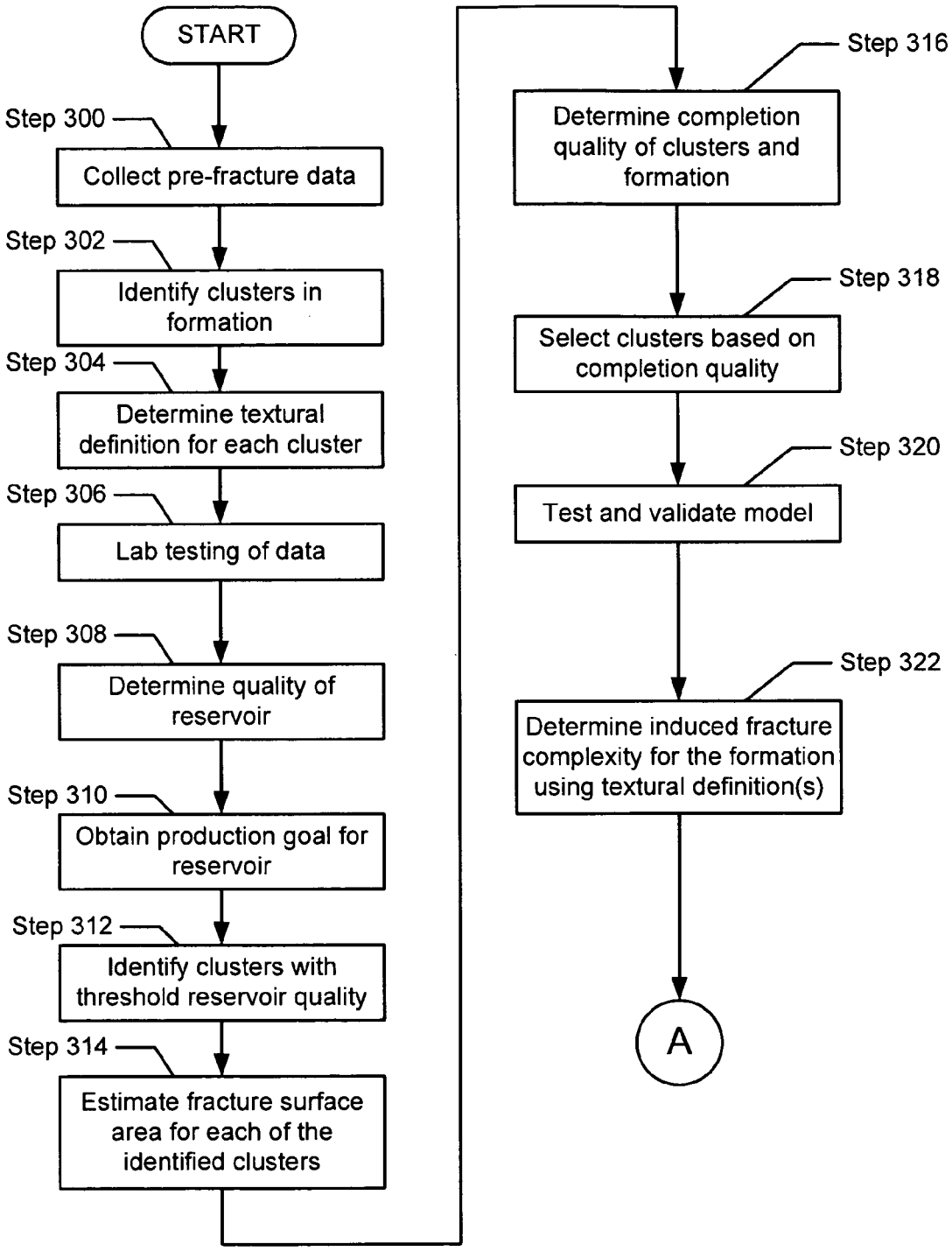
FIG. 3 depicts a flowchart for creating a well plan in accordance with one embodiment of the invention.
Figure 3:
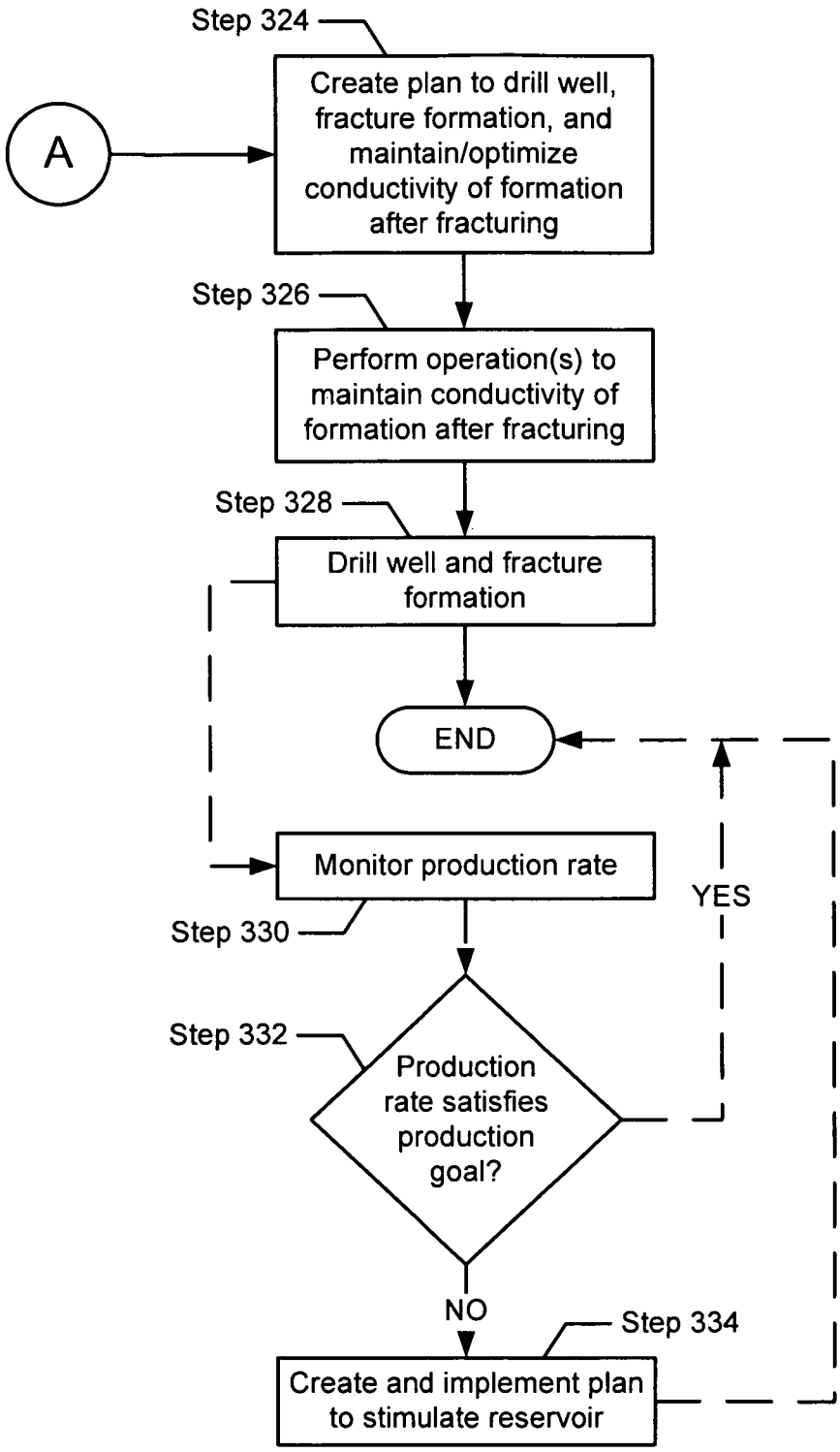
Figure 4:
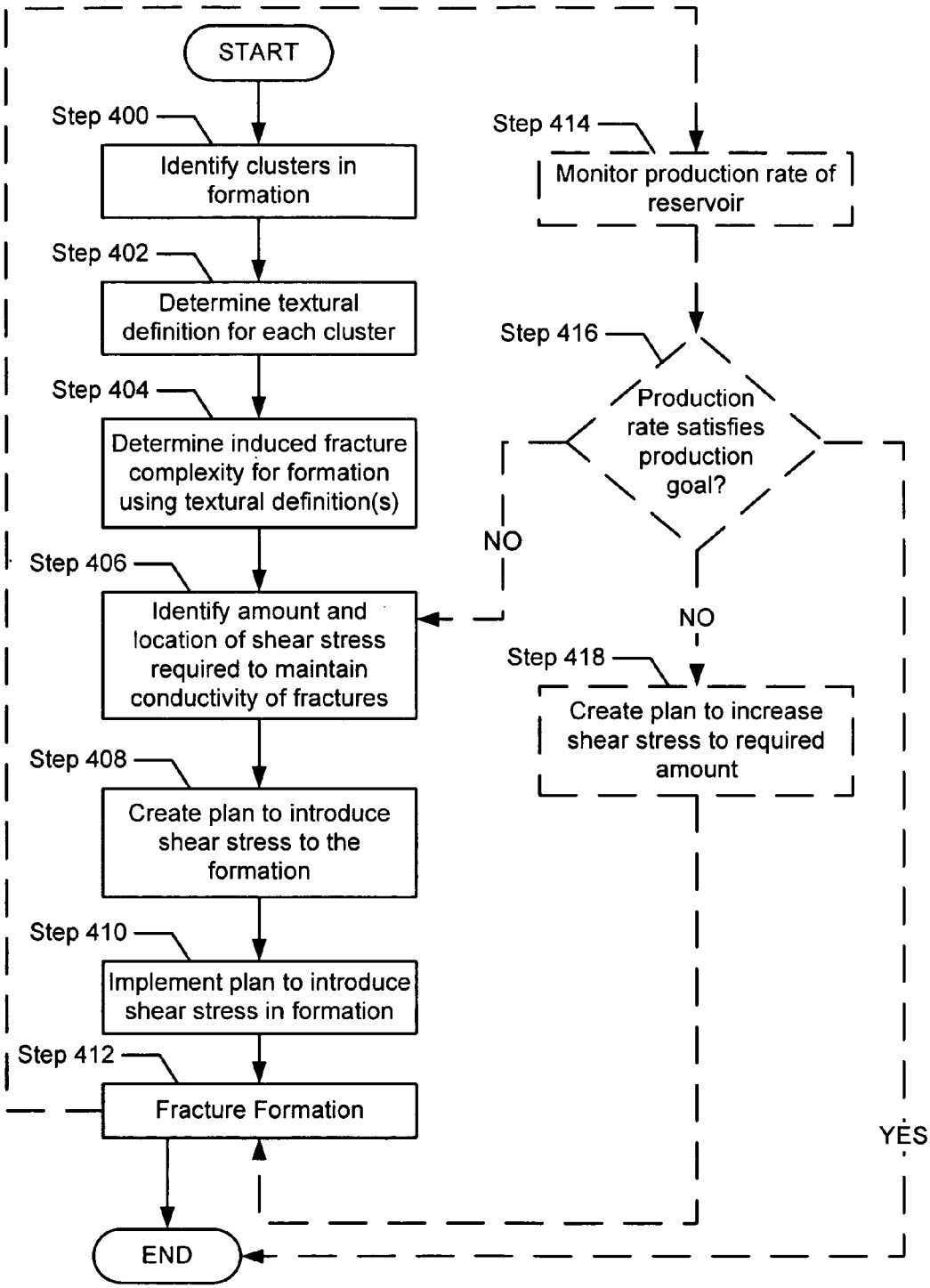
FIG. 4 depicts a flowchart for stimulating a formation to increase production in a reservoir that is currently producing in accordance with one embodiment of the invention.

FIGS. 3-4 describe methods for determining the induced fracture complexity of a formation, determining an amount of shear stress to introduce into the high modulus formation, and determining how to introduce the shear stress into the formation. Specifically, FIG. 3 is directed to using information about a high modulus formation to determine the optimal location to drill a well, an amount and manner of hydraulic fracture treatment to apply to the formation for maximizing production of the reservoir (or meet a production goal set for the reservoir), and/or an amount of shear stress to introduce into the system to stabilize the fractures resulting from the hydraulic fracture treatment and the best manner to accomplish this. FIG. 4 is directed to stimulating a producing wellbore by applying a hydraulic fracture treatment and then determining an amount of shear stress to introduce into the system to stabilize the fractures resulting from the stimulation treatment.

While the various steps in FIGS. 3 and 4 are presented and described sequentially, one of ordinary skill will appreciate that some or all of the steps may be executed in different orders and some or all of the steps may be executed in parallel. Further, in one or more embodiments of the invention, one or more of the steps described below may be omitted, repeated, and/or performed in different order. Accordingly, the specific arrangement of steps shown in FIGS. 3 and 4 should not be construed as limiting the scope of the invention.

FIG. 3 describes a flowchart for drilling a well in accordance with one or more embodiments of the invention. In Step 300, pre-fracture data is collected. Examples of such data include producer requirements of daily flow rates for economic production (in Barrels Per Day (BPD) or Standard Cubic Feet of Gas per Day (SCFD)), samples of reservoir rocks and bounding units (core, rotary sidewall plugs or rock fragments) for material property characterization via laboratory testing, well logs for analysis, and seismic measurements. The collection of this data is generally a continuous process, and the data is processed to reduce redundancies.

In Step 302, clusters in the formation are identified. Each cluster corresponds to a uniform portion of rock in the formation. For example, the material properties and the log responses of the rock (e.g., acoustic responses, resistance responses, etc.) in the cluster are uniform (or relatively uniform). The boundaries between the various clusters in the formation may be defined by the contrasts in material properties and log responses.

Clusters may be identified from analysis of well logs generated using, for example, one or more of the tools described above. Material property definitions for these clusters may be obtained from laboratory testing on cores, sidewall samples, discrete measurements along wellbores, or cuttings. The logs and the samples may subsequently be analyzed to determine core-log relationships defining the properties of the formation. Once the properties of the formation are determined, cluster properties are identified. The results may be used to identify all the relevant reservoir and non-reservoir sections that will play a role in the stimulation design program, and in optimizing the number and location of wells for coring, to have adequate characterization of all principal cluster units.

The analysis of the above samples may be used to provide one or more of the following pieces of information about the rock in the formation: geologic information, petrologic information, petrophysical information, mechanical information, and geochemical information. One or more pieces of this information may be used to generate a log-seismic model, which is then calibrated. Once the log-seismic model is calibrated, seismic measurements alone may be used to identify the clusters. The identification of clusters may be extended to determine the location of each of the clusters within the formation, thus allowing for the identification of formation properties. Clusters may be determined using the methodology and apparatus discussed in U.S. patent application Ser. No. 11/617,993 filed on Dec. 29, 2006, entitled "METHOD AND APPARATUS FOR MULTI-DIMENSIONAL DATA ANALYSIS TO IDENTIFY ROCK HETEROGENEITY" in the names of Roberto Suarez-Rivera, David Handwerger, Timothy L. Sodergren, and Sidney Green, which is hereby incorporated by reference in its entirety.

In Step 304, a textural definition for each of the clusters is determined. The textural definition of a cluster specifies the presence, density, and orientation of fractures in the cluster. The textural definition may be determined by evaluating field data from seismic, log measurements, core viewing, comparisons with bore-hole imaging, and other large-scale subsurface visualization measurements to evaluate the presence of mineralized fractures, bed boundaries, and interfaces separating media with different material properties.

Analysis of wellbore imaging, texture imaging, and fracture imaging logs may be used to determine the presence, density and orientation of open and mineralized fractures intersecting the wellbore. Oriented core, core sections, and side-walled plugs (oriented with wellbore imaging measurements) may also be used to determine the presence, density, and orientation of open and mineralized fractures as seen in the core. This analysis also includes relating large-scale, well scale, and core-scale measurements, to each other and constructing scaling relationships to help understand the presence, distribution, and orientation of fractures around the well under study. For evaluations involving multiple wells, the analysis predicts the distribution of fractures between wells using statistical algorithms (e.g., in-house software code Discrete Fracture Networks (DFN) in Petrel®) (Petrel is a registered trademark of Schlumberger Technology Corporation, Houston, Tex.).

The analysis in Step 304 may also be used to verify the consistency between the measurements conducted at various scales and predict the orientation of fracture propagation. This step may include analysis directed to determining the interaction with mineralized fractures, and the presence, absence and magnitude of induced fracture complexity. Those skilled in the art will appreciate that if clusters are identified using a log-seismic model, then additional field data may need to be collected (as defined above) to determine the textural definition of each cluster. The textural definition for each of the clusters in the formation may collectively be referred to as textural complexity of the formation.

In Step 306, laboratory testing is conducted on the data collected. An example of such testing includes conducting continuous measurements of strength (such as using an in-house system scratch test) for evaluating core-scale heterogeneity. Other examples of such testing include conducting comprehensive laboratory testing for characterization of material properties (geologic, petrologic, petrophysical, mechanical, geochemical, and others) and using the measured properties for providing material definitions to the clusters identified from the log analysis. For multi-well analysis, cluster tagging is used for tracking the presence of the identified cluster units in the reference well or wells, along with those in other wells in the field.

In Step 308, the quality of the reservoir is determined. This determination includes analyzing the laboratory measurements and integrating the results to construct a hierarchical structure defining reservoir quality and completion quality, each ranked from highest to lowest. Reservoir quality may also be defined as the combination of gas field porosity, permeability and organic content. However, it may include other properties (e.g., pore pressure) and textural and compositional attributes, as desired.

In Step 310, the production goal for the reservoir is obtained. The production goal may be specified as SCFD, BPD, volume of hydrocarbon produced per day, or using any other units of measurement.

In Step 312, clusters that meet or exceed threshold reservoir quality are identified. Reservoir quality relates to the ability to produce from the cluster. Using laboratory measurements and predictions of laboratory data using logs, all cluster units identified to have high reservoir quality (from previous analysis) are mapped. The clusters are evaluated based on, for example, gas filled porosity, permeability and total organic carbon (TOC) of the cluster. These cluster units are candidates for fracturing. On the selected units, their reservoir properties (e.g., permeability) are used to calculate the required surface area for economic production. This identification may further include conducting the above analysis on a cluster-by-cluster basis and subsequently using combinations of clusters.

In Step 314, the fracture surface area for each of the clusters identified in Step 312 is determined. More specifically, using the production goal (obtained in Step 310) and the properties of the cluster (obtained in Steps 302 and 304), the surface area for economic production is calculated.

In Step 316, the completion quality of the clusters identified in Step 312 is determined. Completion quality may correspond to the degree of stress contrast in minimum horizontal stress between clusters, as well as the degree of contrast in elastic anisotropic properties, and the effect of these on predicted fracture aperture. Completion quality may also be based on rock fracturability, chemical sensitivity to fracturing fluids, proppant embedment potential, surface area, pore pressure, fracture toughness, tensile strength, textural and compositional attributes that may lead to induced fracture complexity, the degree of interbedding in the containing units, and the properties of these interbeds (interbed stiffness and strength). The completion quality is evaluated based on mechanical, properties, in-situ stress contrast and pore pressure contrast, to evaluate the potential for fracture containment to vertical growth in the identified clusters and the formation as a whole. The analysis identifies the presence of textural features that may enhance or be detrimental to containment (e.g., interbeds and weak bed boundaries determine containment in relation to their interbed density). In addition, the analysis identifies the potential for rock-fracturing fluid sensitivity, and the potential for proppant embedment. As a result of the analysis, the requirements for fracture surface area (determined in Step 314) are modified and/or adjusted to account for loss of surface area associated with poor containment and/or rock-fluid damage.

In Step 318, a subset of clusters identified in Step 312 is selected based on completion quality. In particular, clusters with good completion quality are selected. Factors that establish good completion quality may include, but are not limited to, positive fracture containment to vertical growth between target reservoir sections, low fluid sensitivity, and low proppant embedment potential.

In Step 320, the model is tested and validated against the actual data. Testing the model may include using results of cluster tagging on multiple wells (and predictions of these using seismic-log integration) and evaluating the degree of compliance between the various cluster units in the reference set (cored wells) and the corresponding clusters identified across the field. Testing the model may further include providing a clear visualization of the extent of applicability by the model, and thus the reliability of the predictions across the larger scale region. Validation of the model includes identifying cluster units with good completion quality (e.g., positive fracture containment to vertical growth between target reservoir sections, low fluid sensitivity, and low proppant embedment potential) and good reservoir quality (e.g., high gas filled porosity, high permeability and high organic content). Valuation further includes evaluating how the differences in stacking patterns between known clusters (i.e., lateral heterogeneity) influences the in-situ stress profiles, conditions of containment, fluid sensitivity to specific rock units, and propensity for proppant embedment from well to well. Based on this testing and validation, a strategy is created for fracture design such that the design of each well addresses its unique conditions of reservoir quality and completion quality.

In Step 322, the induced fracture complexity for the formation is determined using the textural definitions of the clusters, textural complexity (e.g., presence of healed fractures and interfaces), and the relative orientation of the clusters to the in-situ stress. Induced fracture complexity defines the anticipated/predicted degree of branching and overall fracture orientation in the formation. Based on scratch test measurements and shear tests, the properties of these fractures and interfaces (e.g., stiffness, cohesion, friction angle) are evaluated. Using mechanical data for all cluster units, the stress contrast between layers is calculated. Based on in-situ stress analysis between two cluster units, the presence, type and orientation of the sources of textural complexity (e.g., mineralize fractures) is predicted. Cluster units with higher density of mineralized fractures will result in more complex fracturing and in higher density of fracturing. Thus, the cluster units will have higher fracturability. This analysis may also include validating the in-situ stress predictions using field data of fracture closure (such as from induced fractures, mini fracs, Modular Formation Dynamics Tester (MDT) or equivalent measurements). In one embodiment of the invention, the field measurements enable users to define the contribution of tectonic deformation to the overall development of the minimum and maximum horizontal stress. Further, this analysis includes predicting fracture geometry, tortuosity, the distribution of fracture apertures, effective surface area, the effective fracture conductivity, and the sensitivity of fracture apertures to stress and to overall production.

In one embodiment of the invention, the orientation of the natural fracture network related to the in-situ stress (AH) orientation is used to determine the degree of induced fracture complexity. Further, if the formation is texturally heterogeneous (i.e., includes clusters with different textural definitions), the interaction between the clusters and the stress orientation result in increased induced fracture complexity. Similarly, if the formation is devoid of texture (i.e., clusters are devoid of any form of intrinsic fabric or larger scale texture resulting from the presence of fractures, interfaces and the like), then the induced fracture complexity is low (i.e., fractures are not complex or branched).

In Step 324, a plan is formulated to drill the well, fracture the reservoir, and maintain/optimize conductivity of reservoir after fracturing is performed. The location and depth of the primary well are selected based on the information obtained and/or calculated in Steps 300-322. With respect to the fracturing, based on spatial heterogeneity (resulting from the presence and types of clusters in the formation) and specific (anticipated or known) well conditions (e.g., near wellbore tortuosity), local reservoir texture (presence of fractures), in-situ stress profiles, conditions of containment, fluid sensitivity to specific rock units, and propensity for proppant embedment may vary significantly. As such, the fracturing treatment for the well and possibly for each section of the well may be unique.

With respect to maintaining conductivity of reservoir after fracturing is performed, the plan may include mechanisms for introducing the shear stress into the formation. Examples of mechanisms to introduce shear stress include introducing zone of compliance or high stiffness in the formation by fracturing wellbores with cement slurries or proppant, preventing closure, to alter the stress conditions; inducing thermal stresses (for example by communicating two wellbores and circulating cooler fluids); and drilling one or more lateral wellbores, where the lateral wellbore(s) has a different diameter, length, and/or geometry as compared to the primary wellbore. Those skilled in the art will appreciate that other mechanisms or techniques known in the art may be used to create shear stress in the formation.

Step 324 may also include reviewing the measured surface area per cluster unit (e.g., from petrologic analysis), reviewing the required surface area for economic production, and reviewing results of fluid-rock compatibility. The above factors provide a measure of the surface area exposed to fluid-rock chemical interactions. Step 324 may further include evaluating the potential for fluid-rock interaction including: imbibition into the rock matrix by capillary suction; surface wetting and water trapping; hardness softening facilitating proppant embedment; tensile strength reduction resulting in the production of fines and reducing the fracture conductivity; and selecting the fracturing fluid that minimizes the above. Those skilled in the art will appreciate that other mechanisms may be used to maintain/optimize conductivity of the formation.

In one embodiment of the invention, the plan for maintaining/optimizing conductivity of the formation is developed to introduce shear stress into the formation to promote self propping of unpropped fractures while also creating asymmetry and shear deformation in the formation. The plan for maintaining/optimizing conductivity may include drilling ancillary wells near the zone to be fractured and placing them open hole (low stiffness) or pressurizing them with cement (high stiffness). Preferably these wellbores are placed horizontally once they enter the reservoir. The plan for maintaining/optimizing conductivity may include fracturing wellbores with cement slurries or proppant, preventing closure, to alter the stress conditions prior to a subsequent main fracture. The plan for maintaining/optimizing conductivity may include communicating two wellbores and circulating cooler fluids and thus inducing thermal stresses along localized regions near the section to be fractured. The two wellbores may have either the same length or different lengths, either the same diameter or different diameters, and may be constructed with the same or different geometry. Numerical modeling indicates that when the diameter of the two wellbores is different, the shear deformation in the region between wellbores increases so different wellbore diameters may be preferable.

In Step 326, the plan to maintain/optimize conductivity of the formation is implemented. In Step 328, the primary well is drilled into the formation and a fracturing operation (e.g., hydraulic fracturing) is performed. For example, the hydraulic fracturing of the primary wellbore and the proximity of the secondary wellbores (drilled in Step 326) could create shear stress for maintaining/optimizing the fracture conductivity of the fractures created in Step 326.

In one embodiment of the invention, one or more wellbores may be drilled in Step 326 and information from the wells collected. The collected information may then be used to update the plan created in Step 324.

Optionally, this process may be continued by performing Steps 330-334. In Step 330, the production rate of the reservoir is monitored. This monitoring includes completing the cycle of prediction execution monitoring and compares predictions and expectations in real time during the treatment (using real time fracture monitoring, such as micro-seismic monitoring). Step 330 further includes monitoring actual versus predicted conditions of vertical fracture growth, fracturing into cluster units identified to be containing units, monitoring induced fracture complexity (branching), and monitoring the overall geometry of the fracture. Unanticipated events are observed and recorded as deviations from the anticipated behavior. After completion, a fracture geometry is fitted into the space defined by the fracture monitoring measurements (acoustic emissions).

Step 330 may further include comparing this fracture geometry with the geometry predicted prior to the treatment. If it is different, the model is reevaluated using the new information. Also, this geometry is input into a reservoir simulator (e.g., Eclipse), for evaluation of production and reservoir recovery. This evaluation also includes comparing the predicted well production, based on the treatment inferred geometry, with the real well production. If the two are different, the effective surface area after pumping is calculated based on this difference. This evaluation further considers the percent reduction in surface area to understand the effect of loss of surface area and fracture conductivity (e.g., insufficient proppant, water trapping, capillary suction and imbibition, proppant embedment or other mechanisms) and the number and predominance of cluster units included in this effect.

In Step 332, a determination is made about whether the production rate satisfies the production goal. If the production rate satisfies the production goal, then the process ends. In Step 334, if the production rate does not satisfy the production goal, then a plan to stimulate the reservoir is created. Required surface area should be increased for regions with poor potential for fracture containment. For wells with a high tendency for developing induced fracture complexity during fracturing, the required treatment volumes are calculated, and problems with flow path tortuosity, proppant transport and loss of fracture conductivity may be determined. For wells with a low tendency for developing induced fracture complexity during fracturing, the required treatment volumes are calculated, and conducting multiple stages for improving recovery are considered. For complex fracturing with low potential for proppant transport, shear enhancement of fracture conductivity is considered. Shear enhancement may be achieved by forcing the fractures to close against their own asperities (self propping) as a result of the added shear. Step 334 may also include selecting the high modulus cluster sections and consider introducing zones of high compliance or high stiffness in the region to be fractured. Step 334 may also include drilling ancillary wells near the zone to be fractured and placing them open hole (low stiffness) or pressurizing them with cement (high stiffness). Step 334 may also include fracturing wellbores with cement slurries or proppant, preventing closure, to alter the stress conditions prior to the main fracture. Step 334 may also include communicating two wellbores and circulating cooler fluids, thus inducing thermal stresses along localized regions near the section to be fractured.

In one embodiment of the invention, the fracturing in Step 328 may be monitored using micro-seismic monitoring (or equivalent) technology. The information obtained from the monitoring is used to generate fracture geometry (i.e., measured surface area). The fracture geometry is then input into a reservoir simulator, for evaluation of production and reservoir recovery. In particular, a predicted well production is generated from the simulation. The predicted well production may then be compared with the real well production. If different, the effective surface area (i.e., measured surface area less the loss of surface area due to insufficient proppant, water trapping, capillary suction and imbibition, proppant embodiment or other mechanisms) of the formation may be determined.

FIG. 4 describes a flowchart for stimulating a formation to increase production in a reservoir that is currently producing in accordance with one embodiment of the invention. In Step 400, clusters in the formation are identified. Each cluster corresponds to a uniform portion of rock in the formation. For example, the portion of rock is deemed uniform because the material properties as well as the log responses of the rock (e.g., acoustic responses, resistance responses, etc.) in the cluster are uniform (or relatively uniform). The boundaries between the various clusters in the formation may be defined by the contrasts in material properties and log responses.

Clusters may be identified from analysis of well logs generated using, for example, one or more of the tools described above. Material property definitions for these clusters may be obtained from laboratory testing on cores, sidewall samples, discrete measurements along wellbores, or cuttings. The logs and the samples may subsequently be analyzed to determine core-log relationships defining the properties of the formation. Once the properties of the formation are determined, cluster properties are identified. The results may be used to identify all the relevant reservoir and non-reservoir sections that will play a role in the stimulation design program, and in optimizing the number and location of wells for coring, to have adequate characterization of all principal cluster units.

The analysis of the above samples may be used to provide one or more of the following pieces of information about the rock in the formation: geologic information, petrologic information, petrophysical information, mechanical information, and geochemical information. One or more pieces of this information may be used to generate a log-seismic model, which is subsequently calibrated. Once the log-seismic model is calibrated, seismic measurements alone may be used to identify the clusters. The identification of clusters may be extended to determine the location of each of the clusters within the formation, thus allowing for the identification of formation properties. Clusters may be determined using the methodology and apparatus discussed in U.S. patent application Ser. No. 11/617,993 filed on Dec. 29, 2006 entitled "METHOD AND APPARATUS FOR MULTI-DIMENSIONAL DATA ANALYSIS TO IDENTIFY ROCK HETEROGENEITY" in the names of Roberto Suarez-Rivera, David Handwerger, Timothy L. Sodergren, and Sidney Green, which is hereby incorporated by reference in its entirety.

In Step 402, a textural definition for each of the clusters is determined. The textural definition of a cluster specifies the presence, density, and orientation of fractures in the cluster. The textural definition may be determined by evaluating field data from seismic, log measurements, core viewing, comparisons with bore-hole imaging, and other large-scale subsurface visualization measurements to evaluate the presence of mineralized fractures, bed boundaries, and interfaces separating media with different material properties.

Analysis of wellbore imaging, texture imaging, and fracture imaging logs may be used to determine the presence, density and orientation of open and mineralized fractures intersecting the wellbore. Oriented core, core sections, and side-walled plugs (oriented with wellbore imaging measurements) may also be used to determine the presence, density, and orientation of open and mineralized fractures as seen in the core. This analysis also includes relating large-scale, well scale, and core-scale measurements, to each other and constructing scaling relationships to help understand the presence, distribution, and orientation of fractures around the well under study. For evaluations involving multiple wells, the analysis predicts the distribution of fractures between wells using statistical algorithms (e.g., software code DFN in Petrel®).

The analysis in Step 402 may also be used to verify the consistency between the measurements conducted at various scales and predict the orientation of fracture propagation. The analysis in Step 402 may also analyze the interaction with mineralized fractures, and the presence, absence and magnitude of induced fracture complexity. Those skilled in the art will appreciate that if clusters are identified using a log-seismic model, then additional field data may need to be collected (as defined above) to determine the textural definition of each cluster. The textural definition for each of the clusters in the formation may collectively be referred to as textural complexity of the formation.

In Step 404, the induced fracture complexity for the formation is determined, and this determination may use the textural definitions of the clusters, textural complexity (e.g., presence of healed fractures and interfaces), and the relative orientation of the clusters to the in-situ stress. Induced fracture complexity defines the degree of branching and overall fracture orientation in the formation. Based on scratch test measurements and direct shear tests, the properties of these fractures and interfaces (e.g., stiffness, cohesion, friction angle) are evaluated. Using mechanical data for all cluster units, the stress contrast between layers is calculated. Based on in-situ stress analysis between two cluster units, the presence, type and orientation of the sources of textural complexity (e.g., mineralize fractures) is predicted. Cluster units with higher density of mineralized fractures results in more complex fracturing and in higher density of fracturing. The analysis to determine the induced fracture complexity of the formation may also include validating the in-situ stress predictions using field data of fracture closure. Field measurements allow the contribution of tectonic deformation to the overall development of the minimum and maximum horizontal stress to be defined. Further, this analysis may include predicting fracture geometry, tortuosity, the distribution of fracture apertures, effective surface area, the effective fracture conductivity, and the sensitivity of fracture apertures to stress and to overall production.

In one embodiment of the invention, the orientation of the natural fracture network related to the in-situ stress (CH) orientation may be used to determine the degree of induced fracture complexity. Further, if the formation is texturally heterogeneous (i.e., includes clusters with different textural definitions), the interaction between the clusters and the stress orientation may result in increased induced fracture complexity. Similarly, if the formation is devoid of texture (i.e., clusters are devoid of any form of intrinsic fabric or larger scale texture resulting from the presence of fractures, interfaces and the like), then the induced fracture complexity may be low (i.e., fractures are not complex or branched).

In Step 406, the amount and location of shear stress required to maintain the conductivity of the fractures is determined. Step 406 assumes that the reservoir is to be re-fractured in order to increase production and that shear stress may be used to stabilize the conductivity of the resulting fractures. The amount and location of shear stress may be determined based on computer simulations of the formation. Alternatively, the amount and location of shear stress may be determined heuristically using information from similar formations. In another alternative, the amount and location of shear stress may not be determined, but rather a determination may be made that shear stress should be gradually introduced into the formation (using techniques discussed below) and then the resulting production rate of the formation monitored. The amount and location of shear stress may be increased until the production rate of the formation satisfies the production goal.

In Step 408, a plan to introduce the shear stress (determined in Step 406) to the formation is created. The plan includes the mechanism for introducing the shear stress into the formation. With respect to the fracturing, based on spatial heterogeneity (resulting from the presence and types of clusters in the formation) and specific (anticipated or known) well conditions (e.g., near wellbore tortuosity), local reservoir texture (e.g., the presence of fractures), in-situ stress profiles, conditions of containment, fluid sensitivity to specific rock units, and propensity for proppant embodiment may vary significantly. As such, the fracturing treatment for the well and possibly for each section of the well may be unique. Examples of mechanisms to introduce shear stress include introducing zone of compliance or high stiffness in the formation by fracturing wellbores with cement slurries or proppant, preventing closure, to alter the stress conditions; inducing thermal stresses by communicating two wellbores and circulating cooler fluids; and drilling one or more lateral wellbores, where these lateral wellbores have a different diameter, length, and/or geometry as compared to the primary wellbore.

Step 408 may include reviewing the measured surface area per cluster unit (e.g., from petrologic analysis), reviewing the required surface area for economic production, and reviewing results of fluid-rock compatibility. The above factors provide a good measure of the surface area exposed to fluid-rock chemical interactions. Step 408 may further include evaluating the potential for fluid-rock interaction including: Imbibition into the rock matrix by capillary suction; surface wetting and water trapping; hardness softening facilitating proppant embedment; and tensile strength reduction, although this tensile strength reduction may result in the production of fines and reduce the fracture conductivity, and so selecting the fracturing fluid that minimizes this loss in conductivity is important. Those skilled in the art will appreciate that other mechanisms may be used to create shear stress in the formation.

In one embodiment of the invention, the plan for introducing shear stress into the formation includes mechanisms that promote self propping of unpropped fractures while also creating asymmetry and shear deformation in the formation. The plan for introducing shear stress into the formation may include drilling ancillary wells near the zone to be fractured and placing them open hole (low stiffness) or pressurizing them with cement (high stiffness). Preferably these wellbores are placed horizontally once they enter the reservoir. The plan for introducing shear stress into the formation may include fracturing wellbores with cement slurries or proppant, preventing closure, to alter the stress conditions prior to a subsequent fracture. The plan for introducing shear stress into the formation may also include communicating two wellbores and circulating cooler fluids, thus inducing thermal stresses along localized regions near the section to be fractured. The two wellbores may have either the same length or different lengths, and they may have the same diameter or different diameters. The two wellbores may also be constructed with the same or different geometry. Numerical modeling indicates that when the diameter of the two wellbores is different, the shear deformation in the region between wellbores increases, and accordingly different wellbore diameters may be preferable. Within the formation, the propagating fracture will be attracted to the ancillary wellbore and forced to intersect, and accordingly the evolution of multiple fractures emanating from the ancillary wellbore may need to be evaluated.

In Step 410, the plan to introduce stress into the formation (developed in Step 408) is implemented in the formation. The introduction of the shear stress into the formation promotes self propping of unpropped fractures in addition to creating asymmetry and shear deformation in the formation.

In Step 412, the formation is fractured. The amount and location of the fracturing is determined using the information obtained and/or determined in Steps 400-404. The formation may be fractured using hydraulic fracturing techniques. Alternatively, fracturing in the formation may be induced by fracturing near a complaint (open hole) wellbore to create wellbore deformation. The wellbore deformation results in various locations with high tensile stresses. Those skilled in the art will appreciate that other fracturing techniques may be used without departing from the invention.

At this stage, the formation has been fractured, resulting in increased surface area. The increased surface area may result in increased production of fluids. However, if complex fractures are formed (i.e., fractures with branching and/or additional features that result in increased surface area), the operations performed in Step 408 preserve the conductivity of the complex fractures (i.e., prevent the fractures from closing).

Optionally, this process may be continued by performing Steps 414-418. In Step 414, the production rate of the reservoir is monitored. This monitoring may include completing the cycle of prediction execution monitoring and may compare predictions and expectations in real time during the treatment (using real time fracture monitoring, such as microseismic monitoring). Step 414 may further include monitoring actual versus predicted conditions of vertical fracture growth, fracturing into cluster units identified to be containing units, monitoring induced fracture complexity (branching), and monitoring the overall geometry of the fracture. Unanticipated events may be observed and recorded as deviations from the anticipated behavior. After completion, a fracture geometry is fitted into the space defined by the fracture monitoring measurements (acoustic emissions).

Step 414 may further include comparing this fracture geometry with the geometry predicted prior to the treatment. If the fracture geometry and the predicted geometry are different, the model is reevaluated using the new information. Also, this geometry may be input into a reservoir simulator for evaluation of production and reservoir recovery. This evaluation may also include comparing the predicted well production, based on the treatment inferred geometry, with the real well production. If the two are different, the effective surface area after pumping may be calculated based on this difference. This evaluation may further consider the percent reduction in surface area to understand the effect of loss of surface area and fracture conductivity (e.g., insufficient proppant, water trapping, capillary suction and imbibition, proppant embedment or other mechanisms) and the number and predominance of cluster units included in this effect.

In Step 416, a determination is made about whether the production rate satisfies the production goal. If the production rate satisfies the production goal, then the process ends. In Step 418, if the production rate does not satisfy the production goal, then a plan to increase the shear stress is created. Required surface area should be increased for regions with poor potential for fracture containment. For wells with a high tendency for developing induced fracture complexity during fracturing, the required treatment volumes may be calculated, and problems with flow path tortuosity, proppant transport and loss of fracture conductivity may be anticipated. For wells with a low tendency for developing induced fracture complexity during fracturing, the required treatment volumes may be calculated, and conducting multiple stages for improving recovery may be considered. For complex fracturing with low potential for proppant transport, shear enhancement of fracture conductivity may be considered. Shear enhancement may be performed by forcing the fractures to close against its own asperities (self propping) as a result of the added shear. Step 418 may also include selecting the high modulus cluster sections and introducing zones of high compliance or high stiffness in the region to be fractured, which may be accomplished by drilling ancillary wells near the zone to be fractured and placing them open hole (low stiffness) or pressurizing them with cement (high stiffness). Introducing zones of high compliance or high stiffness in the region to be fractured may also be accomplished by fracturing wellbores with cement slurries or proppant, preventing closure, to alter the stress conditions prior to the main fracture. Introducing zones of high compliance or high stiffness in the region to be fractured may also be accomplished by communicating two wellbores and circulating cooler fluids, thus inducing thermal stresses along localized regions near the section to be fractured. After Step 418 is complete, the then process proceeds to Step 412. In this scenario, the introduction of additional shear stress increasing the self propping of unpropped fractures may increase the conductivity of the formation.

Alternatively, if the production rate does not satisfy the production goal, then the process may proceed to Step 406. In this scenario, further fracturing of the formation may be required to increase the conductivity of the formation.

Those skilled in the art will appreciate that Step 406 may occur after Step 412. In such cases, the shear stress is already present in the formation at the time the formation is fractured.

The following describes examples in accordance with one or more embodiments of the invention. The examples are not intended to limit the scope of the invention.

Figure 5:
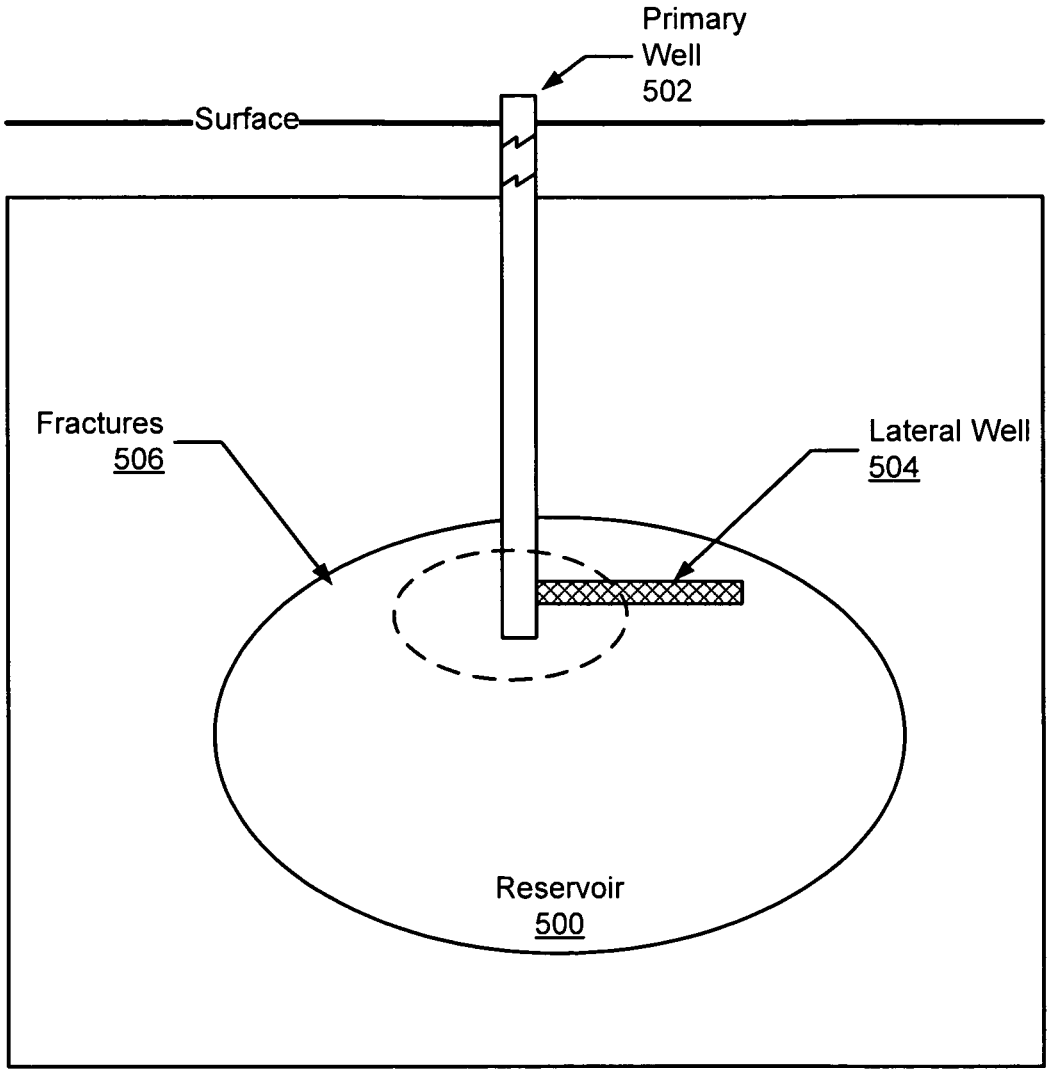
FIGS. 5-6 depict exemplary oilfield operations in accordance with one or more embodiments of the invention.
Figure 6:
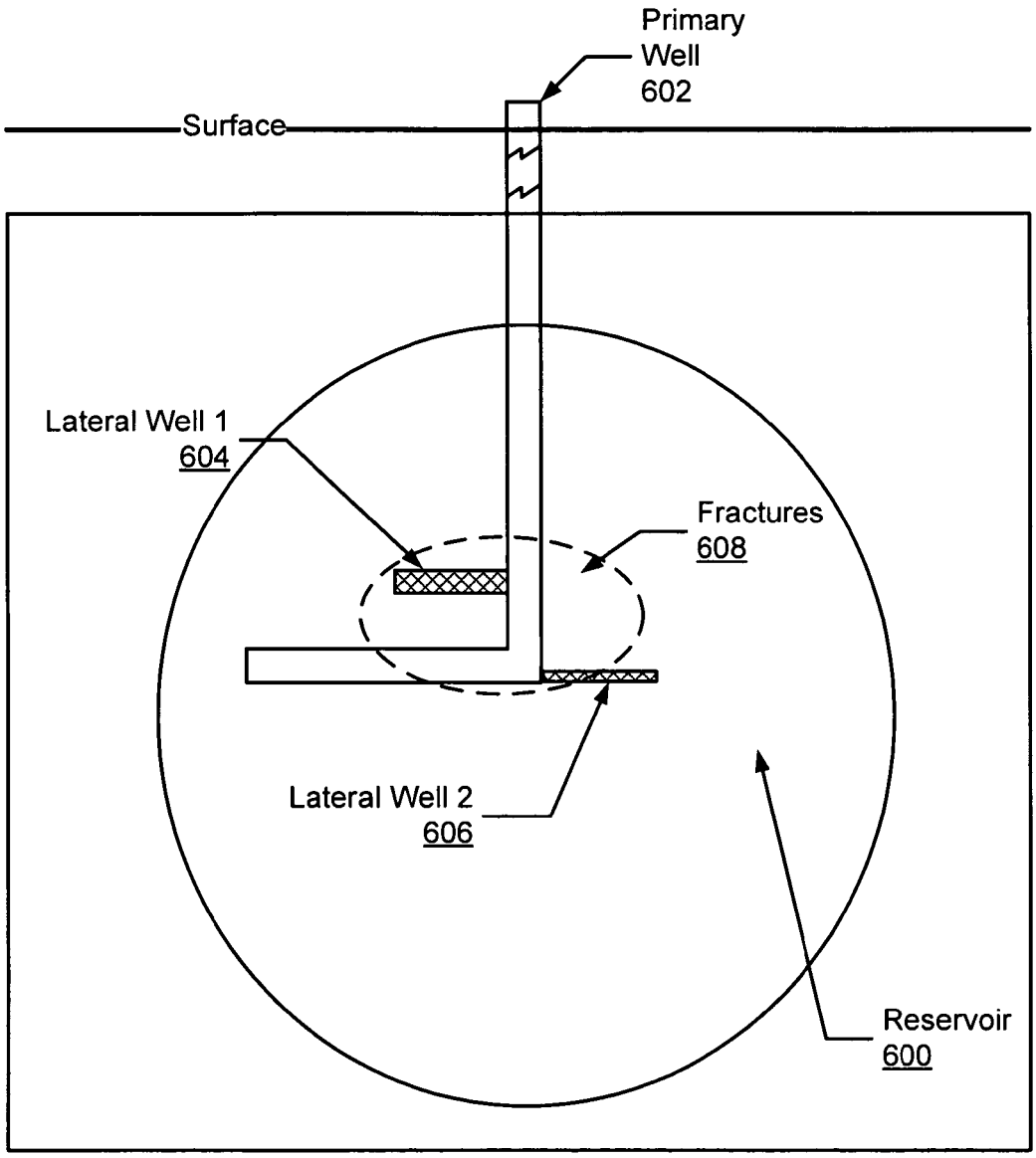

FIGS. 5-6 show exemplary oilfield operations in accordance with one or more embodiments of the invention. More specifically, FIGS. 5-6 show various features used to introduce shear stress to a formation. FIGS. 5-6 are merely exemplary and not intended to limit the scope of the invention.

In FIG. 5, the primary well (502) is determined to be producing below the production goal. To stimulate production in the reservoir (500), the formation is fractured to obtain fractures (506). As discussed above, the fractures (506) increase the surface area of the formation (or at least for a portion thereof). To maintain the conductivity of the fractures (506) after the fracturing, a lateral well (504) is drilled off the primary well (502). Depending on the amount of shear stress required to maintain the conductivity of the fractures (506), the lateral well (504) may be cemented closed.

In FIG. 6, the primary well (602) is determined to be producing below the production goal. To stimulate the production in the reservoir (600), the formation is fractured to obtain fractures (608). As discussed above, the fractures (608) increase the surface area of the formation (or at least for a portion thereof). To maintain the conductivity of the fractures (608) after the fracturing, two lateral wells (604, 606) are drilled off of the primary well (602). Depending on the amount of shear stress required to maintain the conductivity of the fractures (608), one or more of the lateral wells (604, 606) may be cemented closed. Those skilled in the art will appreciate that the laterals wells (604, 606) may be drilled prior to the creation of the fractures (608). Alternatively, one of the lateral wells may be drilled prior to the fracturing while the other lateral well may be drilled after the fracturing. Further, those skilled in the art will appreciate that the number, diameter, geometry, and location of the lateral wells may be adjusted based on the amount of shear stress being introduced into the formation.

In one embodiment of the invention, the fractures (608) are oriented substantially normal (i.e., substantially perpendicular) to lateral well 1 (604). Further, the fractures (608) may be initiated from lateral well 1 (604) and propagate towards the lateral section of the primary well (602). In some cases, the fractures (608) may induce additional fractures in the lateral section of primary well (602).

The following describes examples in accordance with one or more embodiments of the invention. The examples are for explanatory purposes only and are not intended to limit the scope of the invention.

Example 1

Consider a scenario where, prior to fracturing the first wellbore, at least one additional wellbore is drilled to create a localized zone of compliance in the reservoir. Each of these additional wellbores may be larger, smaller, or the same size and shape as the first wellbore, and each additional wellbore may have multiple lateral wells, inclines, or combinations thereof. In one embodiment of the invention, each of these additional wellbores do not have the same lateral extent as the first wellbore. After the localized zone of compliance is created, the first wellbore is pressurized, typically with a proppant, to create fractures, which propagate towards the additional wellbores. When the fractures penetrate the additional wellbores, they equalize pressure throughout the additional wellbores, which evenly distributes the fracture fluid and creates additional multiple fractures that break out on the opposite side of the additional wellbores. The multiple fractures that emanate from the opposite side of the additional wellbore(s) increase the surface area, which in turn increases production of the reservoir.

The embodiment disclosed in Example 1 may provide one or more of the following benefits: (i) if there is no induced fracture complexity in the formation, the additional wellbore(s) creates induced fracture complexity; (ii) the disturbance of the stresses increases the shear stress in the formation, which facilitates the preservation or increase of fracture conductivity; (iii) the additional wellbore(s) serves as a channel for proppant, such the that proppant flows from the first wellbore to the additional wellbore(s) and finally to the multiple fractures of the additional wellbore(s), thereby increasing surface area and conductivity.

Example 2

Consider a scenario that is similar to Example 1 described above, but in this case each of the additional wellbores is filled with a material rather than remaining open hole prior to the fracture. Examples of the material that may be used include, but are not limited to, cement, organic matter, gypsum, starch, or any combination thereof. In one embodiment of the invention, once the material is placed in the additional wellbore(s), sufficient time elapses to allow the material to set and, if applicable, dry. By filling the additional wellbore(s) with the material and allowing the material to set/dry, a larger stress distribution within the formation may be created. The amount of shear stress created and the distribution of such stress within the formation is dependent on the formation, the material used, the location of the additional wellbores, and the number of the additional wellbores. As a result of the increased stress distribution in the formation, there is an increase in the number of fractures within the formation as well as the amount of branching within the formation, and this in turn results in surface area, conductivity, and production of the reservoir.

Example 3

Consider a scenario where, instead of drilling an additional wellbore or a lateral well, the same effect of a fracture may be created in a different way. Initially, the first wellbore is fractured. After the fracture has been created in the first wellbore, the fractured area is filled with a material. Examples of such material include, but are not limited to, cement, organic matter, gypsum, starch, or any combination thereof. Once the material is placed in the first wellbore, the material is allowed sufficient time to set and, if applicable, dry. Then the first wellbore is again stimulated, either by the presence of the material itself or by mechanically induced methods, to create/induce fractures in a volume that includes the first wellbore where the material is located. The resultant fractures create more surface area, which in turn increases production of the reservoir.

Example 4

Consider a scenario where the above Examples 1-3 are combined. For example, after creating a lateral well in the first wellbore, the lateral well is filled with a material. Examples of such material include, but are not limited to, cement, organic matter, gypsum, starch, or any combination thereof. Once the material is placed in the first wellbore, the material is allowed sufficient time to set and, if applicable, dry. Then the first wellbore is stimulated, either by some material or by mechanically induced methods, to induce/create fractures. The resulting fracture migrates towards the lateral well, and the material filling the lateral well creates multiple fractures as the fracture from the first wellbore propagates toward the lateral well. These multiple fracture create more surface area, which in turn increases production of the reservoir.

The invention (or portions thereof) may be implemented on virtually any type of computer regardless of the platform being used. For example, the computer system may include a processor, associated memory, a storage device, and numerous other elements and functionalities typical of today's computers (not shown). The computer may also include input means, such as a keyboard and a mouse, and output means, such as a monitor. The computer system may be connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system may be located at a remote location and connected to the other elements over a network. Further, the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, or any other computer readable storage device.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A method for stimulating production in a wellbore associated with a reservoir, comprising:

determining a textural complexity of a formation in which the reservoir is located, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determining an induced fracture complexity of the formation using the textural complexity;

fracturing the formation to create a plurality of fractures;

determining an operation to perform within the formation to maintain conductivity of the formation based on the induced fracture complexity and the textural complexity; and performing the operation, wherein the operation comprises drilling a lateral well originating from the wellbore to maintain conductivity of the formation.

2. The method of claim 1, wherein the operation further comprises drilling an additional lateral well.

3. The method of claim 2, wherein the lateral well and the additional lateral well have diameters different from one another.

4. The method of claim 1, wherein the wellbore comprises a lateral portion and the lateral well is substantially parallel to the lateral portion.

5. The method of claim 1, wherein the wellbore comprises a lateral portion and the lateral well originates at a heel of the lateral portion.

6. A method for stimulating production in a reservoir, comprising:

determining a textural complexity of a formation in which the reservoir is located, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determining an induced fracture complexity of the formation using the textural complexity;

determining a location to drill a first wellbore using the induced fracture complexity;

drilling, at the location, the first wellbore comprising a lateral well in the formation;

drilling a second wellbore in the formation;

pressurizing the second wellbore using fracturing fluid to create a plurality of fractures, wherein at least one of the plurality of fractures penetrates the first wellbore and wherein the at least one of the plurality of fractures induces a fracture in the first wellbore; and producing hydrocarbons from at least one selected from a group consisting of the first wellbore, the second wellbore, and a third wellbore in the formation.

7. A method for stimulating production in a reservoir, comprising:

determining a textural complexity of a formation in which the reservoir is located, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determining an induced fracture complexity of the formation using the textural complexity;

determining a location to drill a first wellbore using the induced fracture complexity;

drilling, at the location, the first wellbore comprising a lateral well;

drilling a second wellbore in the formation;

filling the second wellbore with a material, wherein the material sets in the second wellbore to create shear stress in the formation and wherein the shear stress induces a plurality of factures in the formation; and producing hydrocarbons from at least one selected from a group consisting of the first wellbore and a third wellbore in the formation.

8. The method of claim 7, wherein the material is cement.

9. A method for stimulating production in a reservoir, comprising:

determining a textural complexity of a formation in which the reservoir is located, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determining an induced fracture complexity of the formation using the textural complexity;

determining a location to drill a first wellbore using the induced fracture complexity;

drilling, at the location, the first wellbore, inducing a first plurality of fractures in a volume surrounding the first wellbore;

filling the first plurality of fractures with a material, wherein the material sets in the first plurality of fractures to induce shear stress in the formation;

inducing fracturing in the volume surrounding the first wellbore after the material sets to generate a second plurality of fractures; and producing hydrocarbons from the first wellbore and a second wellbore in the formation.

10. The method of claim 9, wherein the material is cement.

11. A method for drilling a wellbore, comprising:

identifying a formation and a reservoir in the formation;

determining a textural complexity of the formation, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determining an induced fracture complexity of the formation using the textural complexity;

identifying a location of the wellbore based on the induced fracture complexity and the textural complexity;

fracturing the formation to create a plurality of fractures;

determining an operation to perform within the formation to maintain conductivity of the formation based on the induced fracture complexity and the textural complexity;

drilling the wellbore at the location; and performing the operation within the formation, wherein the operation comprises drilling a lateral well originating from the wellbore to maintain conductivity of the formation.

12. The method of claim 11, wherein the operation further comprises drilling an additional lateral well.

13. The method of claim 12, wherein the lateral well and the additional lateral well have diameters different from one another.

14. The method of claim 12, wherein the wellbore comprises a lateral portion and the lateral well is substantially parallel to the lateral portion.

15. The method of claim 12, wherein the wellbore comprises a lateral portion and the lateral well originates at a heel of the lateral portion.

16. A computer readable medium, embodying instructions executable by a computer to perform method steps for an oilfield operation, the oilfield having at least one wellsite, the at least one wellsite having a wellbore penetrating a formation for extracting fluid from a reservoir therein, the instructions comprising functionality to:

determine a textural complexity of a formation in which the reservoir is located, wherein determining the textural complexity of the formation comprises identifying clusters in the formation, each cluster corresponding to a uniform portion of rock, and determining a textural definition for each cluster specifying the presence, density, and orientation of natural fractures in the cluster, the textural definition of each cluster collectively comprising the textural complexity of the formation;

determine an induced fracture complexity of the formation using the textural complexity;

fracture the formation to create a plurality of fractures;

determine the operation to perform within the formation to maintain conductivity of the formation based on the induced fracture complexity and the textural complexity; and perform the operation within the formation, wherein the operation comprises drilling a first lateral well originating from the wellbore to maintain conductivity of the formation.

17. The computer readable medium of claim 16, wherein the operation further comprises drilling an additional lateral well.

18. The computer readable medium of claim 17, wherein the lateral well and the additional lateral well have diameters different from one another.

19. The computer readable medium of claim 16, wherein the wellbore comprises a lateral portion and the lateral well is substantially parallel to the lateral portion.

20. The computer readable medium of claim 16, wherein the wellbore comprises a lateral portion and the lateral well originates at a heel of the lateral portion.

* * * * *